US009334769B2

(12) United States Patent
Norrick et al.

(10) Patent No.: US 9,334,769 B2
(45) Date of Patent: May 10, 2016

(54) APPARATUSES, SYSTEMS, AND METHODS FOR CRANKCASE OIL SUMP OVERFILL PROTECTION

(71) Applicant: CUMMINS POWER GENERATION, INC., Minneapolis, MN (US)

(72) Inventors: Daniel A. Norrick, New Brighton, MN (US); Paul H. Plahn, Minneapolis, MN (US)

(73) Assignee: Cummins Power Generation IP, Inc., Minneapolis, MN (US)

( * ) Notice: Subject to any disclaimer, the term of this patent is extended or adjusted under 35 U.S.C. 154(b) by 71 days.

(21) Appl. No.: 13/750,102

(22) Filed: Jan. 25, 2013

(65) Prior Publication Data

US 2014/0209053 A1 Jul. 31, 2014

(51) Int. Cl.

| | |
|---|---|
| ***F01M 1/02*** | (2006.01) |
| ***F01M 11/06*** | (2006.01) |
| *F01M 11/02* | (2006.01) |
| *F01M 11/00* | (2006.01) |
| *F02B 75/02* | (2006.01) |

(52) U.S. Cl.

CPC ..... *F01M 11/061* (2013.01); *F01M 1/02* (2013.01); *F01M 11/0004* (2013.01); *F01M 11/02* (2013.01); *F02B 2075/025* (2013.01); *F02B 2075/027* (2013.01)

(58) Field of Classification Search

CPC ..... F01M 11/02; F01M 1/02; F01M 11/0004; F02B 2075/027; F02B 2075/025

USPC ..... 123/196 R

See application file for complete search history.

(56) References Cited

U.S. PATENT DOCUMENTS

| | | | |
|---|---|---|---|
| 1,363,833 | A | 12/1920 | Boyd et al. |
| 1,465,167 | A | 8/1923 | Miller |
| 1,912,190 | A | 5/1933 | Goldberg |
| 1,922,383 | A | 8/1933 | Madden |
| 2,122,427 | A | 7/1938 | Kocher |
| 2,483,448 | A | 10/1949 | Weitzen |
| 2,564,230 | A | 8/1951 | Pitney |
| 2,836,259 | A | 5/1958 | Norton |

(Continued)

FOREIGN PATENT DOCUMENTS

| | | | |
|---|---|---|---|
| CN | 101482058 B | * | 7/2011 |
| EP | 1777383 | | 4/2007 |

(Continued)

OTHER PUBLICATIONS

Kohler Power Systems, Industrial Generator Set Accessories, Sub-base Fuel Tanks specification sheet , 2008, 4 pages.

(Continued)

*Primary Examiner* — Lindsay Low
*Assistant Examiner* — Charles Brauch
(74) *Attorney, Agent, or Firm* — Foley & Lardner LLP

(57) ABSTRACT

Generally, an overflow conduit is described in apparatuses, systems, and methods to protect a crankcase oil sump from overfill. The overflow conduit is to be connected to a crankcase oil sump of an engine, and is configured to passively receive oil from the crankcase oil sump to avoid an overfill condition from occurring in the crankcase oil sump. The overflow conduit is configured to deliver excess oil received to a sub-base tank located relatively below the crankcase oil sump, or in particular at or below an oil level in the crankcase oil sump.

18 Claims, 6 Drawing Sheets

(56) References Cited

U.S. PATENT DOCUMENTS

| | | | |
|---|---|---|---|
| 3,447,636 | A | 6/1969 | Bonfilio |
| 3,929,645 | A | 12/1975 | Bugelski et al. |
| 4,095,571 | A | 6/1978 | Fleetwood et al. |
| 4,392,463 | A | 7/1983 | Yasuhara |
| 4,417,561 | A | 11/1983 | Yasuhara |
| 4,421,078 | A | 12/1983 | Hurner |
| 4,495,909 | A | 1/1985 | Hurner |
| 4,674,456 | A | 6/1987 | Merritt |
| 4,750,456 | A | 6/1988 | Ladrach |
| 4,869,346 | A | 9/1989 | Nelson |
| 5,078,233 | A | 1/1992 | Oetting et al. |
| 5,238,085 | A | 8/1993 | Engelmann |
| 5,336,396 | A | 8/1994 | Shetley |
| 5,390,762 | A | 2/1995 | Nelson |
| 5,476,073 | A | 12/1995 | Betts |
| 5,676,106 | A | 10/1997 | Hoffman, II et al. |
| 5,701,862 | A | 12/1997 | Inoue et al. |
| 5,720,249 | A | 2/1998 | Betts et al. |
| 5,749,339 | A | 5/1998 | Graham et al. |
| 5,806,472 | A | 9/1998 | Nelson et al. |
| 5,881,688 | A | 3/1999 | Graham et al. |
| 5,964,318 | A | 10/1999 | Boyle et al. |
| 5,970,942 | A | 10/1999 | Koeberlein et al. |
| 6,079,380 | A | 6/2000 | Jorgenson et al. |
| 6,082,322 | A | 7/2000 | Graham et al. |
| 6,213,080 | B1 | 4/2001 | Marsh et al. |
| 6,283,082 | B1 | 9/2001 | Gunshore et al. |
| 6,295,971 | B1 | 10/2001 | Peters et al. |
| 6,397,811 | B1 | 6/2002 | Marsh et al. |
| 6,463,796 | B1 | 10/2002 | Van Mullekorn et al. |
| 6,485,632 | B1 | 11/2002 | Ward |
| 6,644,095 | B2 | 11/2003 | Van Mullekom et al. |
| 6,920,779 | B2 | 7/2005 | Carlstrom et al. |
| 7,143,867 | B2 | 12/2006 | Chopra |
| 7,314,115 | B2 | 1/2008 | Ito et al. |
| 7,686,136 | B2 | 3/2010 | Evans |
| 7,699,037 | B2 | 4/2010 | Yamashita et al. |
| 7,828,861 | B1 | 11/2010 | Wong |
| 2002/0088425 | A1* | 7/2002 | Westerbeke, Jr. ..... 123/196 R |
| 2003/0102050 | A1 | 6/2003 | Matthews et al. |
| 2005/0109561 | A1* | 5/2005 | Chopra ..... 184/103.1 |
| 2006/0196575 | A1 | 9/2006 | Nakamura et al. |
| 2009/0139484 | A1 | 6/2009 | Harris |
| 2009/0199708 | A1* | 8/2009 | Milo et al. ..... 95/30 |

FOREIGN PATENT DOCUMENTS

| | | | |
|---|---|---|---|
| GB | 1347683 | A * | 2/1974 |
| WO | 83/00207 | | 1/1983 |
| WO | 98/26162 | | 6/1998 |
| WO | 01/53663 | | 7/2001 |
| WO | 2009/073113 | | 6/2009 |

OTHER PUBLICATIONS

Oil Level Maintainers, Regulators and Controllers, located online at: http://www.fwmurphy.co.uk/products/prodtype_fluid_level_maintainers.htm, available at least as of Nov. 6, 2011, 1 page.

* cited by examiner

APPARATUSES, SYSTEMS, AND METHODS FOR CRANKCASE OIL SUMP OVERFILL PROTECTION

FIELD

Generally, protection from overfill of an engine crankcase oil sump is described. Apparatuses, systems and methods directed to protect a crankcase oil sump from overfill, such as in an engine of a power generator set are described.

BACKGROUND

Engine driven equipment, such as for example, a generator set (genset) which includes an engine and an alternator to generate power, often can have an oil level maintainer to supply make-up oil to the engine crankcase from a separate source of oil and also to regulate the oil level in a crankcase oil sump and to provide oil exchange capability. A reason for using an oil level maintainer is because such engine driven equipment may be operating unattended for extended periods of time and it is important to maintain lubrication of engine components or moving parts that are subject to frictional wear by regulating the oil level such as for example in the crankcase oil sump to maintain a suitable level of oil for the engine system. Improvements can be made to engine driven equipment that employ oil level maintainers, regulators, and/or exchangers.

SUMMARY

Generally, apparatuses, systems, and methods to protect a crankcase oil sump from overfill are described, as well as embodiments of components and devices for the same. Generally, the apparatuses, systems, and methods herein include an overflow conduit, such as for example a standpipe. The overflow conduit is to be connected to a crankcase oil sump of an engine, and is configured to passively receive oil from the crankcase oil sump to avoid an overfill condition from occurring in the crankcase oil sump. In one embodiment, the overflow conduit is configured to deliver the oil received to a sub-base tank below the crankcase oil sump.

The overflow conduit described herein is useful in engine driven equipment, such as for example, a genset, as such gensets can often have an oil level maintainer to supply make-up oil to the engine crankcase from a separate source of oil and also to regulate the oil level in a crankcase oil sump and to provide oil exchange capability. An oil level maintainer may be used for example because such engine driven equipment may be operating unattended for extended periods of time, such as in applications of remote engine or genset installation. Oil level maintainers help to maintain lubrication of engine components by regulating the oil level such as for example in the crankcase oil sump to maintain a suitable level of oil for the engine system. If the oil level regulation system malfunctions, the engine crankcase may be overfilled with lube oil resulting in potential engine damage or oil spillage. The overflow conduit in the apparatuses, systems, and methods herein can help in avoiding crankcase oil sump overfill, while allowing suitable lubrication of the engine, thus improving the operating life of an engine.

In one embodiment, a method of preventing overfill of an crankcase oil sump in an engine of a generator set includes receiving excess oil from a crankcase oil sump in an engine of a generator set by an inlet of an overflow conduit. Receiving the excess oil includes the excess oil passively entering the inlet of the overflow conduit when a condition is present in which there is an excess amount of oil inside the crankcase oil sump that is above an amount of oil to be contained within a predetermined oil level inside the crankcase oil sump. The excess oil is directed through the inlet of the overflow conduit, through a passage of the overflow conduit, and through an outlet of the overflow conduit. Directing the excess oil includes directing the excess oil out of the engine crankcase oil sump to a reservoir physically located relatively at or lower than the predetermined oil level. The amount of oil inside the engine crankcase oil sump is limited to a level at or below the predetermined oil level.

In some embodiments, directing the excess oil includes directing the excess oil to a fuel tank positioned relatively lower than the engine crankcase oil sump. In some embodiments, the method can further include diluting the excess oil with fuel present in the fuel tank to be burned during generator set operation.

In some embodiments, directing the excess oil includes directing the excess oil to a reservoir that is an oil source of an engine oil make-up system. In some embodiments, the excess oil is recirculated to the engine crankcase oil sump to be used in the engine of the generator set.

In some embodiments, receiving excess oil includes a condition in which a failure or malfunction of an engine oil make-up system has occurred.

In one embodiment, a system to prevent overfill of a crankcase oil sump in an engine of a power genset includes an oil source with an oil outlet. The system includes an engine with components to drive the power genset and with a crankcase oil sump that has an oil inlet and an oil outlet. The system includes a conduit connected to the oil outlet of the oil source and connected to the oil inlet of the crankcase oil sump. The system includes an oil level regulator disposed along the conduit to regulate the delivery of oil from the oil source to the crankcase oil sump. The system includes an overflow conduit with an inlet connected to the oil outlet of the crankcase oil sump. The inlet is configured to passively receive excess oil from the crankcase oil sump when a condition is present in which there is an excess amount of oil inside the crankcase oil sump that is above an amount of oil to be contained within a predetermined oil level inside the crankcase oil sump. The overflow conduit is configured to maintain an oil level inside the crankcase oil sump at or below the predetermined oil level. The overflow conduit includes an outlet. The system further includes a reservoir physically located relatively at or lower than the predetermined oil level. The reservoir includes an inlet connected to the outlet of the overflow conduit. The overflow conduit is configured to deliver excess oil received by the inlet of the overflow conduit, through the outlet of the overflow conduit, and into the reservoir.

In some embodiments, the inlet of the overflow conduit is positioned with the outlet of the crankcase oil sump above the predetermined oil level. In some embodiments, the position relative to the predetermined oil level is below a crankshaft present in the engine.

In some embodiments, the reservoir is a fuel tank positioned relatively lower than the crankcase oil sump. In some embodiments, the reservoir is a portion of the oil source that is physically located relatively lower than the crankcase oil sump, and a recirculation line is in fluid communication with the oil source to communicate the excess oil back to the oil source.

BRIEF DESCRIPTION OF THE DRAWINGS

Reference is now made to the drawings in which like reference numbers represent corresponding parts throughout.

DETAILED DESCRIPTION

Generally, apparatuses, systems, and methods to protect a crankcase oil sump from overfill are described, as well as embodiments of components and devices for the same. Generally, the apparatuses, systems, and methods herein include an overflow conduit. The overflow conduit is to be connected to a crankcase oil sump of an engine, and is configured to passively receive oil from the crankcase oil sump to avoid an overfill condition from occurring in the crankcase oil sump. The overflow conduit is configured to deliver the oil received to a sub-base reservoir or tank below the crankcase oil sump.

The overflow conduit described herein is useful in engine driven equipment, such as for example, a genset, as such gensets can often have an oil level maintainer to supply make-up oil to the engine crankcase from a separate source of oil and also to regulate the oil level in a crankcase oil sump and to provide oil exchange capability. An oil level maintainer may be used for example because such engine driven equipment may be operating unattended for extended periods of time, such as in applications of remote engine or genset installation. Oil level maintainers help to maintain lubrication of engine components by regulating the oil level such as for example in the crankcase oil sump to maintain a suitable level of oil for the engine system. If the oil level regulation system malfunctions, the engine crankcase may be overfilled with lube oil resulting in potential engine damage, fire hazard, or oil spill. The overflow conduit in the apparatuses, systems, and methods herein can help in avoiding crankcase oil sump overfill, while allowing suitable lubrication of the engine, thus allowing the engine to continue to operate and avoid damage, lubrication oil spills, or fire hazards in the event of a malfunction of the oil maintainer system.

Figure 1A:
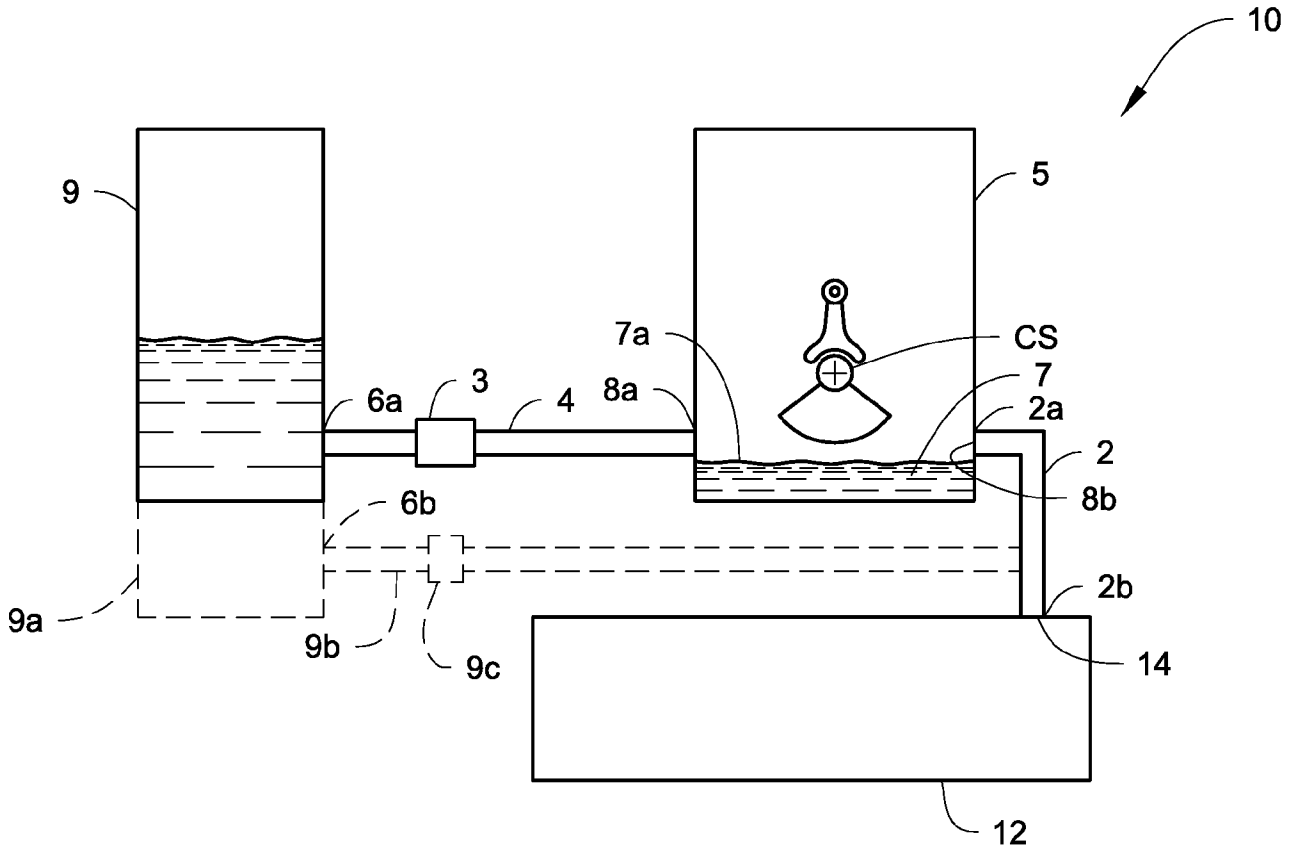
FIGS. 1A-1D are schematic views of embodiments of an engine system that show embodiments of an overflow conduit to protect an engine crankcase oil sump from overfill.

FIG. 1A is a schematic view of an engine system 10 that shows one embodiment of an overflow conduit 2 to protect an engine crankcase oil sump 7 from overfill. The overflow conduit 2 can be configured and arranged for example as a standpipe.

In the embodiment shown, the system 10 is for an engine 5 used in a power generator set, but may be used in other prime mover or engine applications. The engine 5 includes components to drive the power genset and has a crankcase oil sump 7 with an oil inlet 8*a* and an oil outlet 8*b*. The system 10 includes an oil source 9 containing oil with an oil outlet 6*a*. The system 10 includes a conduit 4 connected to the oil outlet 6*a* and connected to the oil inlet 8*a* of the crankcase oil sump 7. The system 10 includes an oil level regulator 3 disposed along the conduit 4 to regulate the delivery of oil from the oil source 9 to the crankcase oil sump 7.

The system 10 includes an overflow conduit 2 with an inlet 2*a* connected to the oil outlet 8*b* of the crankcase oil sump 7. The inlet 2*a* of the overflow conduit 2 is configured to passively receive excess oil from the crankcase oil sump 7 when a condition is present in which there is an excess amount of oil inside the crankcase oil sump that is above an amount of oil to be contained within a predetermined oil level 7*a* inside the crankcase oil sump (see amount of oil depicted by oil level 7*a*). The overflow conduit 2 includes a flow passage from the inlet 2*a* to an outlet 2*b*.

The overflow conduit 2 is configured to maintain an oil level inside the crankcase oil sump at or below the predetermined oil level 7*a*. In some embodiments, the relative placement of the inlet 2*a* of the overflow conduit 2 at a certain position in the crankcase oil sump 7 can help to set the position of the predetermined oil level 7*a*, which can allow for the passive flow of excess oil into the overflow conduit 2. The system 10 further includes a reservoir 12 physically located relatively lower than the crankcase oil sump 7, in particular, at or lower than the oil level in the crankcase oil sump 7. The reservoir 12 includes an inlet 14 connected to the outlet 2*b* of the overflow conduit 2. The overflow conduit 2 is configured to deliver excess oil received by the inlet 2*a* of the overflow conduit 2, through the outlet 2*b* of the overflow conduit 2, and into the reservoir 12. As shown, the reservoir 12 is positioned directly below or under the crankcase oil sump 7.

It will be appreciated that by "physically located relatively lower", what is meant is that the reservoir 12 is positioned so the outlet 2*b* of the overflow conduit 2 can exit excess oil received by the inlet 2*a* of the overflow conduit 2 using, for example the force of gravity. That is, the overflow conduit 2, including its inlet 2*a*, outlet 2*b* and flow passage are arranged with respect the reservoir 12 and crankcase oil sump 7 so that drainage of excess oil can occur passively using the force of gravity. It will be appreciated that the reservoir 12 could be positioned at or relatively below the lubrication oil level in the crankcase oil sump 7, but not necessarily directly under the crankcase oil sump 7 as shown in FIG. 1A. For example, the reservoir 12 could be completely or partially positioned relatively to the side of the crankcase oil sump 7 and still be relatively below the lubrication oil level in it. It will also be appreciated that the entire reservoir 12 need not be physically located below the crankcase oil sump 7, as long as the inlet 2*a*, outlet 2*b*, and flow passage of the overflow conduit 2 are arranged to allow for passive transfer of excess oil from the crankcase oil sump 7 into the reservoir 12. It will also be appreciated that the term "reservoir" is not meant to be limiting, as excess oil may be collected or otherwise contained in any suitable structure, either alone or with other fluids, and perhaps temporarily, and can be any suitable structure such as for example a tank or dedicated container.

With further reference to the overflow conduit 2, in some embodiments, such as shown in FIG. 1A, the inlet 2*a* of the overflow conduit 2 is positioned with the outlet 8*b* of the crankcase oil sump 7 above the predetermined oil level 7*a*. In some embodiments, this position or location of the inlet 2*a* relative to the predetermined oil level 7*a* is below a crankshaft CS present in the engine 5. It may be desired to not have the oil level up to or in contact with the CS to preserve engine operation and avoid splashing, entraining, or foaming of the oil in the sump 7 during engine operation.

In some embodiments, such as shown in FIG. 1A, the overflow conduit 2 can include either one or both of a side extending portion in fluid communication with the inlet 2*a* of the overflow conduit 2 and an upright portion in fluid communication with the outlet 2*b* of the overflow conduit 2. As shown in FIG. 1A, the side extending portion can extend generally perpendicular and outward relative to the outlet 8*b* of the crankcase oil sump 7 and the inlet 2*a* of the overflow conduit 2. The upright portion as shown in FIG. 1A can extend generally vertically relative to the side extending portion and the outlet 2*b* of the overflow conduit 2 and the inlet of the reservoir 12. The side extending portion is connected to the upright portion and is in fluid communication therewith. In the embodiment shown, the side extending portion has a length that is shorter than a length of the upright portion.

It will be appreciated that the side extending portion may extend in an orientation or at angles other than perpendicular. For example, the side extending portion may extend somewhat downward relative to the outlet 8*b* of the crankcase oil sump 7 and the inlet of the 2*a* of the overflow conduit 2. It will also be appreciated that the upright portion may extend in an orientation or at angles other than vertical. For example, the upright portion could be slightly tilted along its length relative to the outlet 2*b* of the overflow conduit 2 and the inlet 14 of the reservoir 12. Generally, the orientation and sections of the overflow conduit 2 are not necessarily limited to the specific structure shown in FIG. 1, as long as the passive receiving and exiting of excess oil can be achieved into and through the overflow conduit 2.

Figure 1B:
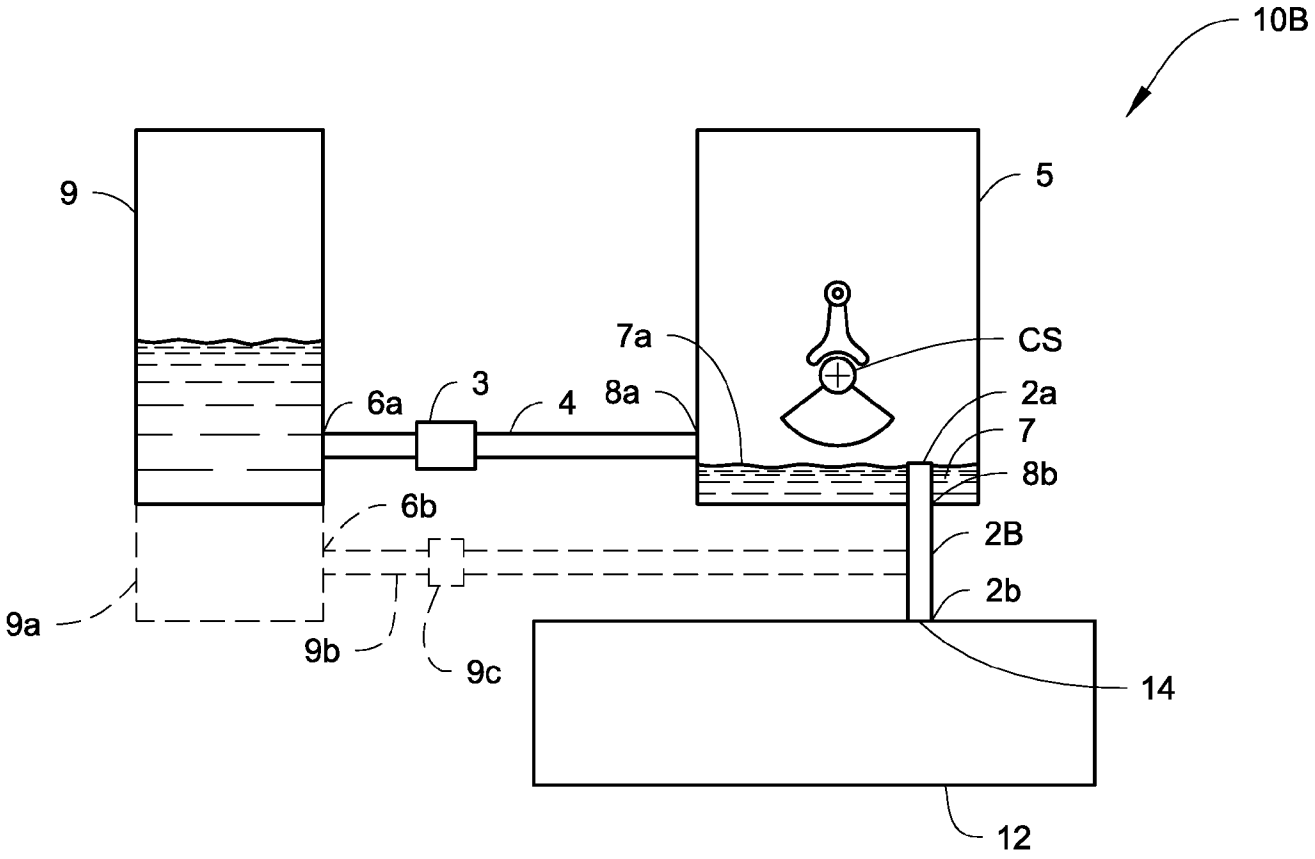
Figure 1C:
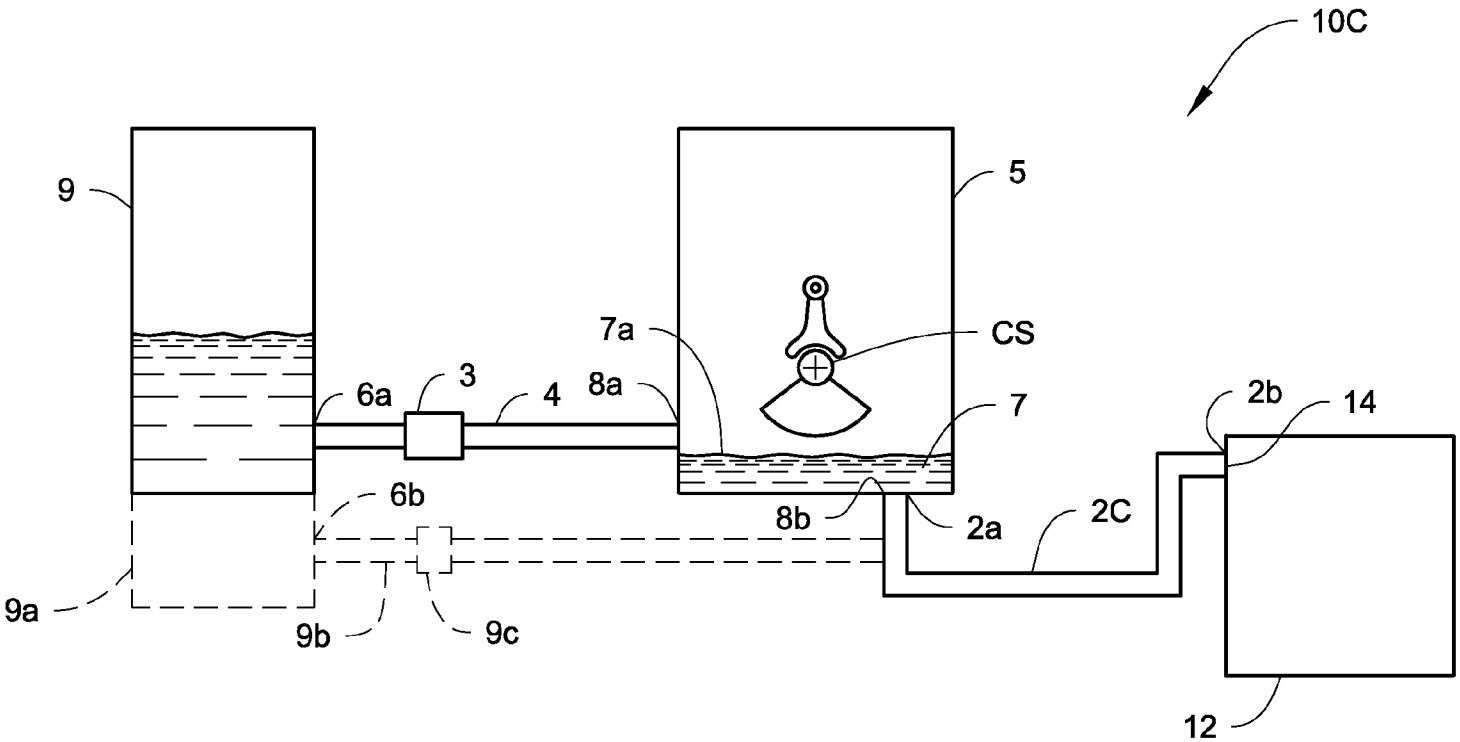
Figure 1D:
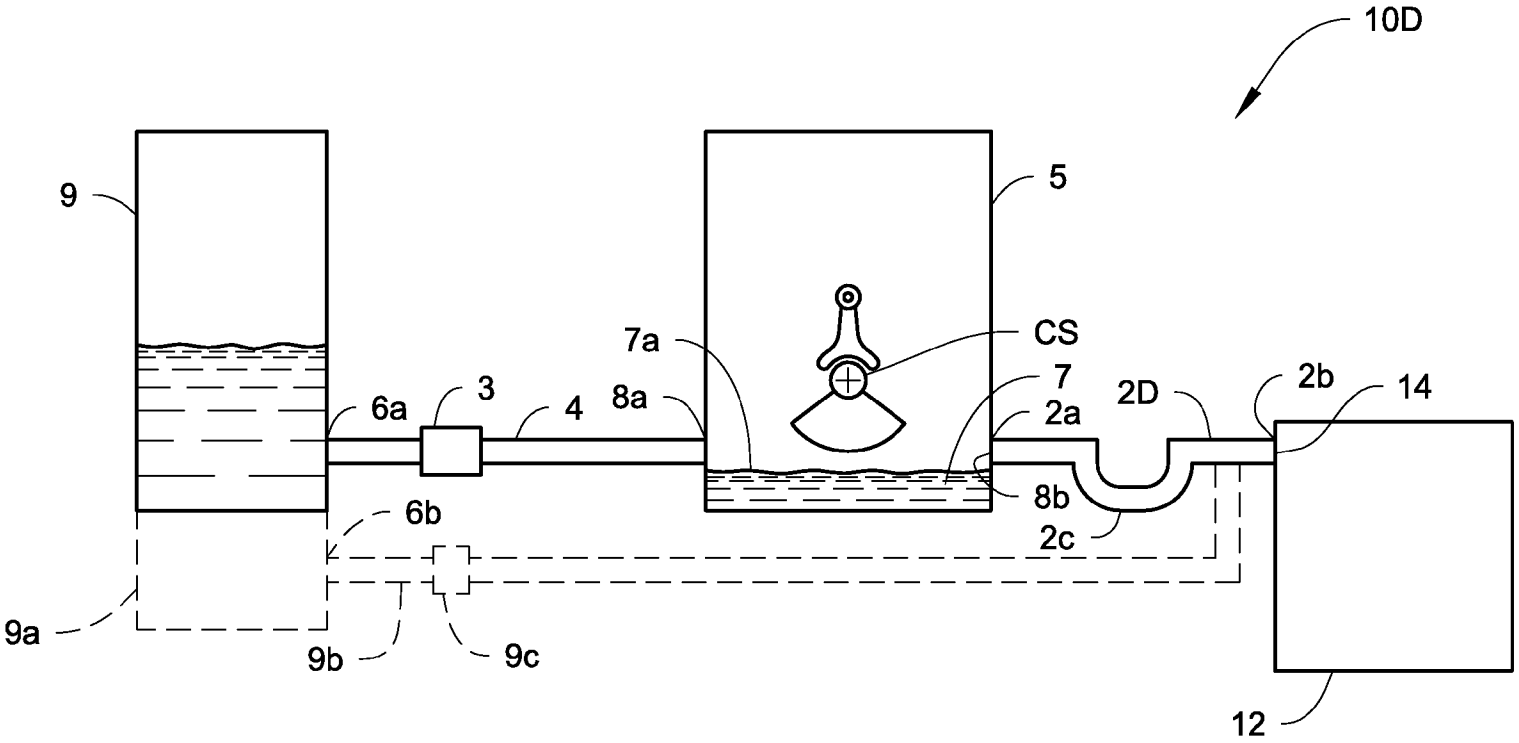

FIGS. 1B to 1D show other embodiments of overflow conduits 2B, 2C, 2D, where like references from FIG. 1A are used, some of which are not further described, and where the structure and arrangement of the overflow conduit as shown in FIGS. 1B to 1D is different and where the reservoir 12 may be positioned differently relative to FIG. 1A. The overflow conduits of FIGS. 1B to 1D may or may not be configured as standpipes, depending on the orientation of portions of the overflow conduit and whether there may be a vertically arranged section.

In the embodiment shown in FIG. 1B, another system 10B shows the inlet 2*a* of overflow conduit 2B positioned internal to the crankcase oil sump 7 and structured so the overflow conduit 2B exits the outlet 8*b* at the bottom (or can exit the side) of the crankcase oil sump 7 substantially at or below the level of inlet 2*a*. In one embodiment, conduit 2B is a vertical pipe placed in the crankcase oil sump 7 and passing through the bottom of the crankcase oil sump. In FIG. 1B, the inlet 2*a* to the overflow conduit is positioned internal to the crankcase oil sump 7 such that it is at or above the predetermined oil level 7*a*. With this placement of inlet 2*a*, excess oil will flow from the crankcase oil sump 7 when the oil level exceeds the height of inlet 2*a* and the predetermined oil level 7*a*.

In the embodiment shown in FIG. 1C, another system 10C has the reservoir 12 placed substantially at the level of the predetermined oil level 7*a* in the crankcase oil sump 7. The outlet 8*b* of the crankcase oil sump 7 to inlet 2*a* of the overflow conduit 2 can be placed substantially at or near the bottom of the crankcase oil sump 7 (could be on a side thereof and toward the bottom). Another embodiment of an overflow conduit 2C is structured to allow flow of excess oil generally horizontally and vertically up to the overflow conduit outlet 2*b* placed at or above the predetermined oil level 7*a* and flow into the inlet 14 located on a side and/or proximate the top of oil reservoir 12, such that excess oil can flow from the crankcase oil sump 7 into the oil reservoir 14 when the oil level exceeds the height of outlet 2*b* and the predetermined oil level 7*a*.

In the embodiment shown in FIG. 1D, another system 10D shows the oil reservoir 12 placed substantially at or below the level of the predetermined oil level 7*a* in the crankcase oil sump 7. The outlet 8*b* of the crankcase oil sump 7 to inlet 2*a* of the overflow conduit 2D is placed substantially at or above the predetermined oil level 7*a*. The overflow conduit 2D is structured to allow flow of excess oil horizontally through a liquid gas trap 2*c* to the overflow conduit outlet 2*b* into the inlet 14 of the reservoir 12, both of which may be placed approximately at or above the predetermined oil level 7*a*, such that excess oil can flow from the crankcase oil sump 7 into the oil reservoir 12 when the oil level exceeds the height of the predetermined oil level 7*a*. It is noted that, while the liquid trap 2*c* is detailed in FIG. 1D as a simple vertical bend or dip in overflow conduit 2, other liquid trap designs are possible and will be apparent to those skilled in the art with the benefit of the present disclosure. It is further noted that the liquid "traps" of the embodiments of FIG. 1D can advantageously be utilized to keep blow by and other vapors contained in the engine crankcase, where they can handled with by the engine's pollution controls and crankcase ventilation systems (such as a positive crankcase ventilation (PCV) system). It will also be appreciated that the liquid trap 2*c* may be suitably applied to the conduct embodiments shown in FIGS. 2A, 2B, and 2C.

With reference to the reservoir 12, the reservoir 12 in one embodiment can be a fuel tank positioned relatively lower than the crankcase oil sump 7, or in particular relatively at or below the predetermined oil level 7*a*. In some embodiments, the excess oil can be diluted with fuel present in the fuel tank to be burned for example during generator set operation. It will be appreciated that, in many circumstances, the fuel tank, e.g. reservoir 12, can have about 1000 units of fuel, while the oil source can have about 15-20 units of oil, and the crankcase oil sump 7 can be constructed to contain about 1 to 5 units of oil, in relative proportion to each other, whether the units are gallons or liters or other common volumetric measurement. It is noted that other relative proportions are possible and contemplated. With the relative amounts of fuel and oil, drainage of excess oil from the crankcase oil sump 7 into, for example, a fuel tank, e.g. reservoir 12, can be easily diluted and burned with the fuel such as during genset operation, without adversely affecting operation of the genset.

In some embodiments, a portion 9*a* of the oil source 9 may be adapted for use as a reservoir. In the embodiment shown in any of FIGS. 1A to 1D, a portion 9*a* of the oil source 9, e.g. a portion of the container can be physically located relatively lower than the crankcase oil sump 7. A recirculation line 9*b* can be used that is in fluid communication with an inlet 6*b* of the oil source 9. In such a configuration, excess oil can be communicated back to the oil source 9 and be reused. It will be appreciated that a filter 9*c* may also be employed to filter contaminants that may be present in the excess oil. The use of a portion 9*a* of the oil source 9 as the reservoir can be suitably applied to any of the embodiments of FIGS. 1A to 1D.

Figure 2:
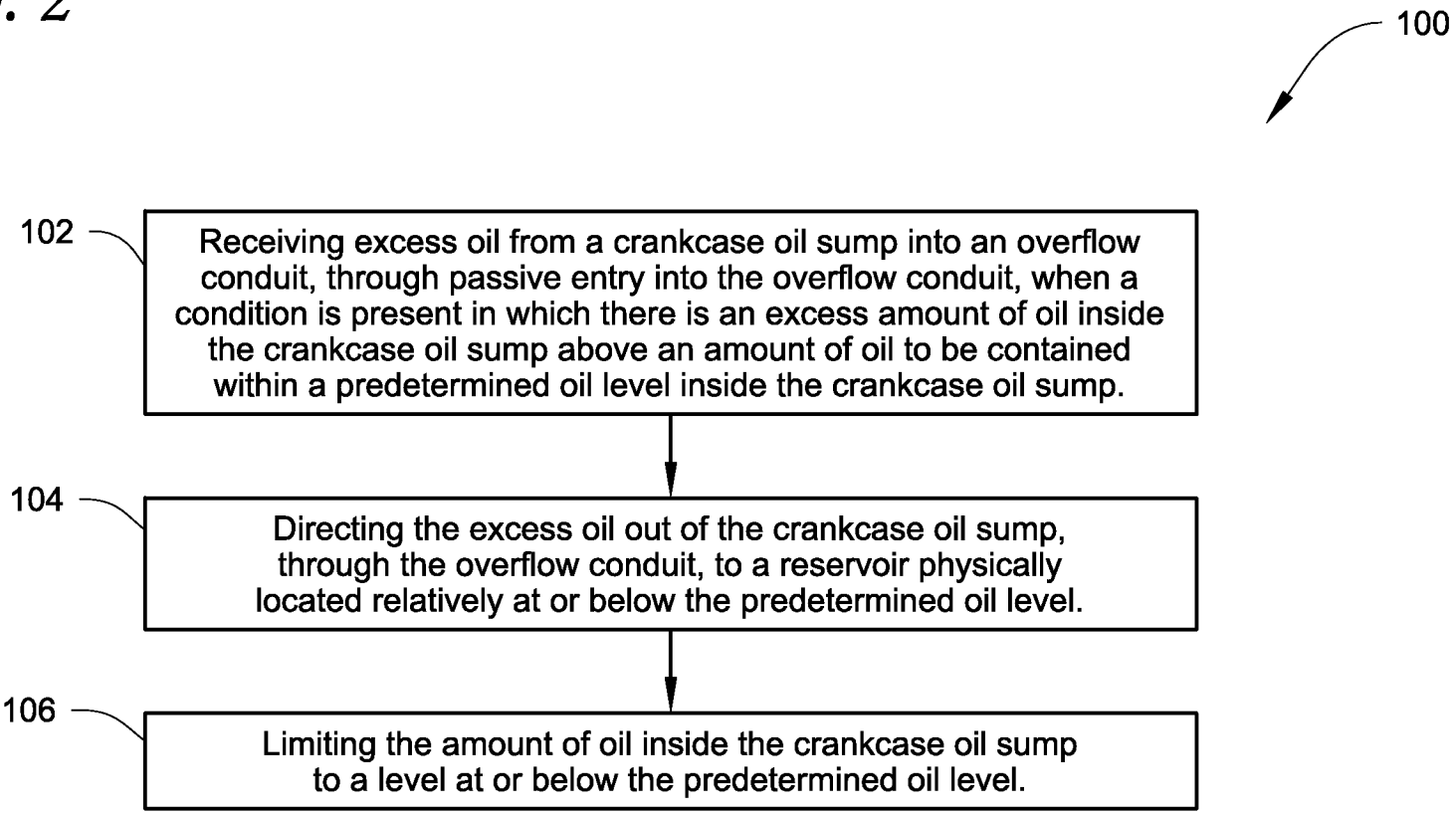
FIG. 2 is a flow chart of a method to prevent overfill of an engine crankcase oil sump.

FIG. 2 is a flow chart 100 of one embodiment of a method to prevent overfill of an engine crankcase oil sump. It will be appreciated that in some embodiments, the methods and systems herein operate under various conditions, one of which can include the overflow conduit to receive excess oil during a condition in which a failure or malfunction of an engine oil make-up system has occurred, for example in the oil source 9, conduit 4, and regulator 3 components of FIG. 1. Such a condition can cause oil to enter the crankcase oil sump 7 and increase the level of oil in the crankcase oil sump 7 to undesired levels, e.g. above predetermined oil level 7*a* in FIG. 1.

The method includes 102 receiving excess oil from a crankcase oil sump in an engine of a generator set or other prime mover or other engine application by an inlet of an overflow conduit. Receiving the excess oil 102 includes the excess oil passively entering the inlet of the overflow conduit when a condition is present in which there is an excess amount of oil inside the crankcase oil sump that is above an amount of oil to be contained within a predetermined oil level inside the crankcase oil sump. The excess oil is directed 104 through the inlet of the overflow conduit, through a passage of the overflow conduit, and through an outlet of the overflow conduit. Directing the excess oil 104 includes directing the excess oil out of the engine crankcase oil sump to a reservoir physically located relatively lower than the crankcase oil sump. The amount of oil inside the engine crankcase oil sump is limited 106 to a level at or below the predetermined oil level.

As described for example with respect to FIGS. 1A to 1D, in some embodiments directing the excess oil 106 can include directing the excess oil to a reservoir 12, such as a fuel tank positioned relatively lower than the engine crankcase oil sump or in particular approximately at or below the predetermined oil level 7*a*. For example, excess oil can be directed from the crankcase oil sump, e.g. crankcase oil sump 7, through overflow conduit, e.g. overflow conduit 2, to the fuel tank, e.g. reservoir 12. In some embodiments where the reservoir 12 is a fuel tank, the method can further include diluting the excess oil with fuel present in the fuel tank to be burned during engine operation.

As also described with respect to FIGS. 1A to 1D, for example, in some embodiments directing the excess oil includes directing the excess oil to a reservoir that is an oil source of an engine oil make-up system. For example, excess oil may be directed through a recirculation line, e.g. recirculation line 9*b*, from the crankcase oil sump, e.g. crankcase oil sump 7, back to the oil source, e.g. oil source 9 for reuse.

Figure 3:
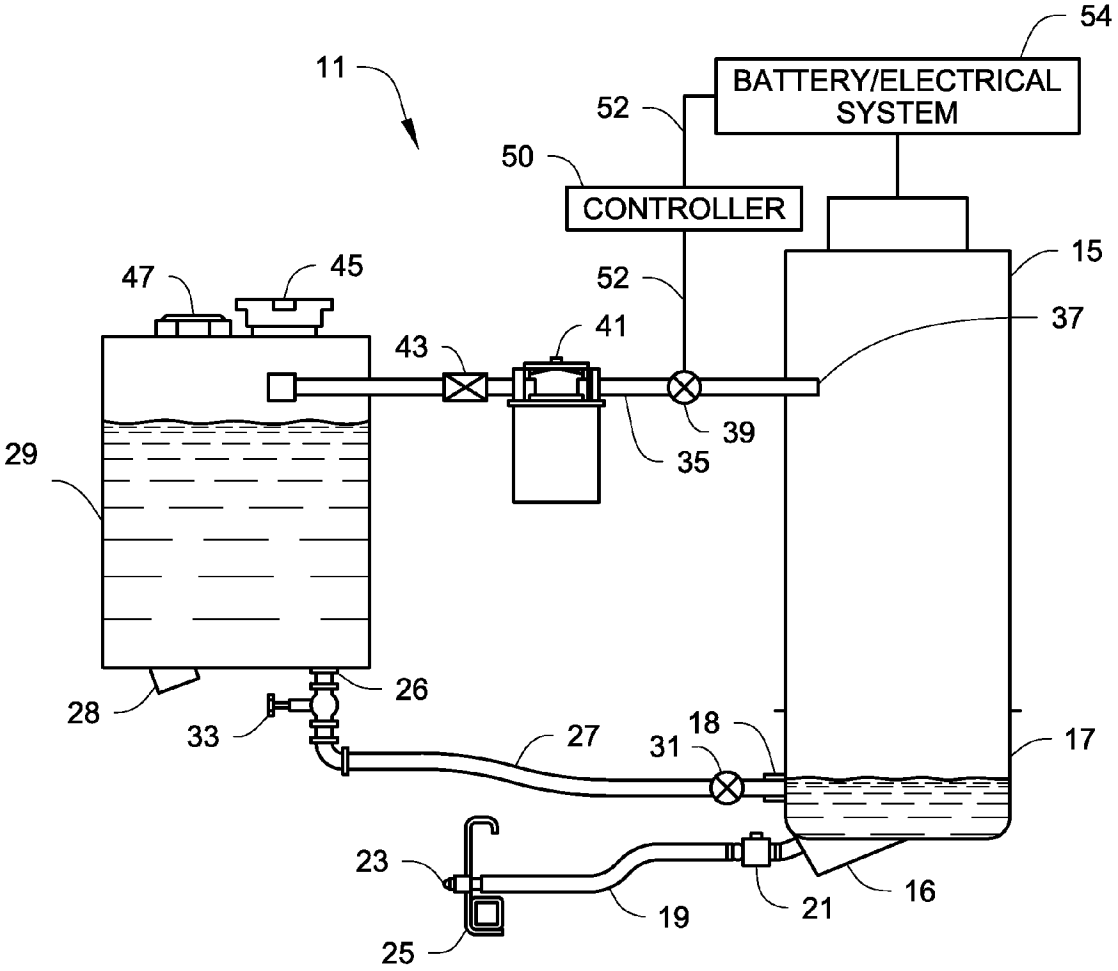
FIG. 3 is a diagrammatic illustration of a known engine oil makeup and extended operation oil exchange system.

FIG. 3 is a diagrammatic illustration of a known engine oil makeup and extended operation oil exchange system 11, in which the methods and systems herein may be implemented, including implementation of any of the overflow conduits described above in FIGS. 1A to 1D. FIG. 3 and descriptions herein are from U.S. Pat. No. 5,238,085, which is incorporated by reference herein.

Referring to FIG. 3, an embodiment of an engine oil makeup and extended operation oil exchange system 11 of the present invention, generally referred to by reference numeral 11, is shown in association with an engine 15 which is lubricated by engine oil in an engine oil sump 17, such as an engine crankcase oil sump. An oil conduit 27 interconnects an outlet 26 of an oil tank 29 containing engine oil to an inlet 18 of the oil sump 17 so as to provide an oil passageway therebetween. The oil conduit 27 includes proximate one end a regulator 31. The oil conduit 27 further includes proximate an opposite end an oil tank valve 33 proximate the outlet 26 of the oil tank 29. Fresh oil flows from the oil tank 29 through the oil tank valve 33 to the regulator 31 when the oil tank valve 33 is opened. When the oil tank valve 33 is closed, oil flow from the oil tank 29 to the regulator 31 is prohibited. As shown, the oil tank 29 can be positioned at an elevation greater than the oil sump 17 so that oil flows from the oil tank 29 to the oil sump 17 due to gravity. Thus, the oil tank valve 33 can be a simple ball type valve which simply opens and closes the oil passageway. It will be appreciated that, alternatively, a pump may be incorporated to drive oil flow in oil conduit 27, which can allow oil tank 29 to be mounted below oil sump 17, or be remotely mounted at a distance. For example, such a pump if employed can be located anywhere along the oil conduit 27.

When the oil tank valve 33 is open, the regulator 31 regulates fresh oil flow from the oil tank 29 to the oil sump 17 in response to the level of the oil in the oil sump 17 so as to maintain the desired oil level in the oil sump 17.

In one embodiment, the regulator 31 is a float type valve or can include an electrical float switch or sensor adapted to electrically actuate the oil regulator 31 which opens and closes in response to the changing level of engine oil in the oil sump 17. If a float switch or sensor is used at the regulator 31, an option for a level of control can be provided to regulate oil flow to the oil sump 17, such as through suitable operable connection to a controller, e.g. controller 50 described further below.

Accordingly, the regulator 31 is closed when the oil level in the oil sump 17 reaches the predetermined oil level at which the amount of engine oil in the oil sump 17 is maintained, while the regulator 31 is opened when the oil level in the oil sump 17 drops below the predetermined oil level. The regulator 31 remains opened until the oil level in the oil sump 17 raises to the desired predetermined oil level. It will be appreciated that the regulator 31 might comprise a conventional float type valve or other well known oil regulation devices.

Further in some embodiments such as shown in FIG. 3, an oil conduit 35 connects a pressurized oil source 37 on the engine 15 with the oil tank 29 so as to provide an oil passageway therebetween. Accordingly, oil under pressure flows from the pressurized oil source 37 on the engine 15 to the oil tank 29. The pressurized oil source 37 might be at any location along the engine's oil lubrication system, where oil is being circulated, such as for example under pressure by an oil pump that may be present as part the engine 15. During engine operation, oil is typically pumped under pressure throughout an engine 15 by the engine's oil pump. By tapping into any of the locations in the engine where oil is being circulated under pressure can provide a pressurized oil source 37. A suitable connector can be used to provide a fluid tight connection of the oil conduit 35 to the pressurized oil source 37. Disposed along the oil conduit 35 may be an oil exchange shutoff valve 39 and a restriction orifice 43. The oil exchange shutoff valve 39 opens and closes the oil passageway. When the oil exchange shutoff valve 39 is opened, the oil under pressure is allowed to transfer from the engine 15 to the oil tank 29. When the oil exchange shutoff valve 39 is closed, oil is not allowed to transfer from the engine 15 to the oil tank 29. The oil exchange shutoff valve 39 can be an electrically activated valve such as a solenoid activated valve. Accordingly, the oil exchange shutoff valve 39 enables and disables the exchange of oil between the engine 15 and the oil tank 29. An oil filter 41 can be used to filter oil flowing from the engine 15 through the oil exchange shutoff valve 39 so that filtered oil flows to the oil tank 29. The oil filter 41 can be used in addition to the oil filtration that is normally an integral part of the engine's operation. In an alternative embodiment, the oil filter 41 need not be present. The restriction orifice 43 may be used to restrict oil flow from the engine 15 and thereby restrict the rate of oil exchange between the engine 15 and the oil tank 29. This can prevent oil from leaving the engine 15 too quickly, thereby ensuring that the rate of oil exchange is sufficiently restrained so as to allow the make-up oil from oil conduit 27 to maintain an adequate supply of oil in the engine 15 for lubrication. It will be appreciated that the rate of oil flow may vary from engine to engine.

In the embodiment shown, the engine oil sump 17 includes a remote oil outlet 16. An oil conduit 19 is attached to the outlet 16 and includes an oil pan drain valve 21 proximate the outlet 16. An oil drain pipe plug 23 is positioned proximate the end of the conduit 19. A support bracket 25 is shown as supporting the end of the conduit 19. Accordingly, oil in the oil sump 17 can be drained through the outlet 16.

In the embodiment shown in FIG. 3, an oil fill cap 45 at the top of the oil tank 29 can allow an operator to fill fresh oil in the oil tank 29. The oil fill cap 45 also prevents fresh oil from vaporizing. A mechanical or electrical oil level gauge or sensor 47 beside the oil fill cap 45 at the top of the oil tank 29 or other level indication device or method can measure the amount of oil in the oil tank 29. An oil tank drain 28 can be positioned at the bottom of the oil tank 29 for draining oil from the oil tank 29.

Accordingly, oil in the oil tank 29 can be drained either through the oil tank drain 28 or through the oil sump 17 and the oil conduit 19.

In the embodiment shown in FIG. 3, a controller 50 can be used to monitor the hours of engine operation and, upon detection of a predetermined period of engine operation, open the oil exchange shutoff valve 39. In the embodiment shown, the controller 50 is electrically interconnected by an electrical conductor 52 to an engine's electrical system 54 and the oil exchange shutoff valve 39. In one embodiment, the controller 50 might be interconnected to a part of the engine's electrical system 54 which is energized when the engine is running. The controller 50, in this case, monitors the amount of time that the electrical system is energized, which corresponds to the amount of time the engine is running. Upon detection of the predetermined amount of time, the controller 50 signals the oil exchange shutoff valve 39 to open via the electrical conductor 52. It will be appreciated that a conventional controller 50 might be used, so as to contain suitable logic for activating the oil exchange shutoff valve 39 upon detection of the predetermined amount of time. While the amount of time may vary from engine to engine, a typical time of engine operation might be about 300 hours, however this is one example of duration of engine operation, and it will be appreciated that other durations both longer and shorter may apply. In other embodiments, the controller 50 might also, or alternatively, monitor the occurrence of some other predetermined condition and upon the occurrence of such condition; e.g., quality of oil in the oil sump 17, level of oil in the oil tank 29, etc., the controller 50 can open the oil exchange shutoff valve 39. If the quality of oil in the oil sump 17 is monitored, for example, a suitable sensor might be placed in the oil sump 17 to sense oil quality.

In use, for example, when initially setting up the system, fresh engine oil is placed in the oil tank 29. The oil tank valve 33 is then opened. Fresh oil flows under the influence of gravity for example, through the optional orifice to the regulator 31. The controller 50 can have the oil exchange shutoff valve 39 initially closed to prevent oil in the oil sump 17 from leaving the engine 15. Thus, the engine can initially run in the oil makeup mode. The regulator 31 regulates the amount of oil allowed to flow into the oil sump 17 until oil level in the oil sump 17 reaches the predetermined oil level and then maintains the oil at that level. Upon the occurrence of a predetermined condition, for example, a predetermined period of time of engine operation, the controller 50 opens the oil exchange shutoff valve 39 to allow oil under pressure to flow from the engine 15 to the oil tank 29. Meanwhile, oil in the oil tank 29 can be fed by gravity to the oil sump 17 through the regulator 31 which maintains the oil level in the oil sump 17. Thus, oil in the oil tank 29 and oil in the oil sump 17 are exchanged. The engine 15 is now in the extended operation oil exchange mode. The system can remain in the extended operation oil exchange mode until stopped by a user for an oil change. In the extended operation oil exchange mode, the volume of oil available for engine lubrication is increased.

With regard to the overflow conduits such as the overflow conduits shown in FIGS. 1A-1D, it will be appreciated that the various overflow conduit embodiments 2, 2B, 2C, and 2D can be implemented in system 11 of FIG. 3. For example, an outlet can be made (e.g. outlet 8*b* shown in FIG. 1) in the crankcase oil sump 17 of FIG. 3, and an inlet of the overflow conduit 2 (e.g. inlet 2*a* shown in FIG. 1) can be positioned and located relative to the outlet made in the crankcase oil sump 17. A reservoir, e.g. reservoir 12 from FIG. 1 can be incorporated with an inlet (e.g. inlet 14 of FIG. 1) to receive excess oil that may be present in the crankcase oil sump 17 of FIG. 3 through the outlet (e.g. outlet 2*b*) of the overflow conduit 2. The overflow conduit 2 allows excess oil to flow from the engine crankcase into the reservoir 12 in case of failure of the oil makeup and extended operation oil exchange system 11 or upon the oil level in the crankcase oil sump 17 reaching the level of the inlet 2*a* to the overflow conduit 2. In one embodiment, reservoir 12 is a standalone reservoir for receiving excess oil from the crankcase that is positioned approximately at or below the level of the inlet 2*a* and the predetermined maximum crankcase oil sump 17 oil level. In another embodiment reservoir 12 is a fuel tank that is positioned approximately at or below the level of the inlet 2*a* and the pre-determined maximum crankcase oil sump 17 oil level. In a further embodiment, reservoir 12 is a portion of the oil tank 9, 29 that is physically located approximately at or below the level of the inlet 2*a* and the pre-determined maximum crankcase oil sump 17 oil level.

With regard to the oil recirculation, it will be appreciated that the oil recirculation components of systems 10, 10B, 10C, and 10D in FIGS. 1A-1D could be implemented into the system 11 of FIG. 3. For example, the oil conduit 35, restriction orifice 43, oil filter 41, shutoff valve 39, could be moved to be in a similar position as in FIGS. 1A-1D to create the oil recirculation through use of the overflow conduit 2 and force of gravity principle shown in FIG. 1.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

The invention claimed is:

1. A method of preventing overfill of a crankcase oil sump in an engine of a generator set, the method comprising:

receiving excess oil from the crankcase oil sump in the engine of the generator set by an inlet of an overflow conduit, including excess oil passively entering the inlet of the overflow conduit when an excess amount of oil inside the crankcase oil sump is above an amount of oil to be contained within a predetermined oil level inside the crankcase oil sump;

directing the excess oil through the inlet of the overflow conduit, through a passage of the overflow conduit, and through an outlet of the overflow conduit, wherein directing the excess oil includes directing the excess oil out of the engine crankcase oil sump when the excess oil exceeds the predetermined oil level to a reservoir located relatively at or lower than the predetermined oil level;

and controlling a flow of oil through the inlet of the overflow conduit to limit the amount of oil inside the engine crankcase oil sump to a level at or lower than the predetermined oil level, wherein one of the outlet and the inlet of the overflow conduit is positioned above the predetermined oil level of the crankcase oil sump.

2. The method of claim 1, wherein directing the excess oil comprises directing the excess oil to a reservoir that comprises a fuel tank positioned relatively lower than a predetermined excess oil level of the engine crankcase oil sump.

3. The method of claim 2, further comprising diluting the excess oil with fuel present in the fuel tank, which fuel is burned during generator set operation.

4. The method of claim 1, wherein directing the excess oil comprises directing the excess oil to a reservoir that comprises an oil source of an engine oil make-up system.

5. The method of claim 4, further comprising recirculating the excess oil to the engine crankcase oil sump and supplying the recirculated excess oil to the engine of the generator set.

6. The method of claim 1, wherein the excess oil is received when a failure or malfunction of an engine oil make-up system has occurred.

7. The method of claim 1, wherein directing the excess oil through the inlet of the overflow conduit, through the passage of the overflow conduit, and through the outlet of the overflow conduit to the reservoir includes directing the excess oil through a liquid gas trap of the overflow conduit.

8. A system of a power genset to prevent overfill of a crankcase oil sump of the power genset comprising:

an oil source that includes an oil outlet;

an engine to drive the power genset, the engine including the crankcase oil sump with an oil inlet and an oil outlet;

a conduit connected to the oil outlet of the oil source and connected to the oil inlet of the crankcase oil sump;

an oil level regulator disposed along the conduit to regulate delivery of oil from the oil source to the crankcase oil sump;

an overflow conduit including an inlet connected to the outlet of the crankcase oil sump, the inlet being configured to passively receive excess oil from the crankcase oil sump when an excess amount of oil inside the crankcase oil sump is above an amount of oil to be contained within a predetermined oil level inside the crankcase oil sump, the overflow conduit being configured to maintain an oil level inside the crankcase oil sump at or lower than the predetermined oil level, the overflow conduit including an outlet; and a reservoir located relatively at or lower than predetermined oil level in the crankcase oil sump, the reservoir including an inlet connected to the outlet of the overflow conduit, wherein the overflow conduit is configured to deliver excess oil received by the inlet of the overflow conduit through the outlet of the overflow conduit and into the reservoir through the inlet of the reservoir when the excess oil exceeds the predetermined oil level, wherein the predetermined oil level is set based on a relative placement of the inlet of the overflow conduit in the crankcase oil sump, and wherein one of the outlet and the inlet of the overflow conduit is positioned above the predetermined oil level of the crankcase oil sump.

9. The system of claim 8, wherein one of the outlet and the inlet of the overflow conduit is positioned above the predetermined oil level, the predetermined oil level being below a crankshaft present in the engine.

10. The system of claim 8, wherein the reservoir comprises a fuel tank positioned relatively lower than the crankcase oil sump.

11. The system of claim 8, wherein:

the oil source includes a portion to receive excess oil, the portion of the oil source comprises the reservoir, and the portion of the oil source is located relatively at or lower than the predetermined oil level in the crankcase oil sump, and the portion further comprises a recirculation line in fluid communication with the oil source to communicate the excess oil back to the oil source.

12. The system of claim 8, wherein the overflow conduit includes a side extending portion in fluid communication with the inlet of the overflow conduit and an upright portion in fluid communication with the outlet of the overflow conduit, the side extending portion is connected to the upright portion, and the side extending portion has a length that is shorter than the upright portion.

13. The system of claim 8, wherein the overflow conduit penetrates the crankcase oil sump below the predetermined oil level, and the inlet of the overflow conduit is disposed at or above the predetermined oil level in the crankcase oil sump.

14. The system of claim 8, wherein the inlet to the overflow conduit is coupled to the side or bottom of the crankcase oil sump below the predetermined oil level, and the outlet of the overflow conduit is disposed on the reservoir at a location approximately at or above the predetermined oil level.

15. The system of claim 8, wherein the overflow conduit includes a liquid gas trap.

16. A crankcase oil overflow system to prevent overfill of a crankcase oil sump of a power genset comprising:

an engine to drive the power genset, the engine including the crankcase oil sump;

an overflow conduit including an inlet connected to an outlet of the crankcase oil sump, the inlet adapted to passively receive excess oil from the crankcase oil sump when oil inside the crankcase oil sump is above a predetermined oil level inside the crankcase oil sump, the overflow conduit including an outlet;

and a reservoir located relatively at or below the predetermined oil level in the crankcase oil sump, the reservoir including an inlet connected to the outlet of the overflow conduit, wherein the overflow conduit is adapted to deliver excess oil received by the inlet of the overflow conduit into the reservoir through the inlet of the reservoir when the excess oil exceeds the predetermined oil level, and wherein the predetermined oil level is set based on a relative placement of the inlet of the overflow conduit in the crankcase oil sump, and wherein one of the outlet and the inlet of the overflow conduit is positioned above the predetermined oil level of the crankcase oil sump.

17. The crankcase oil overflow system of claim 16, wherein the reservoir comprises a fuel tank positioned relatively at or lower than predetermined oil level of the crankcase oil sump.

18. The crankcase oil overflow system of claim 16, wherein a portion of an oil source for the engine comprises the reservoir, and the portion of the oil source is located relatively at or lower than the predetermined oil level of the crankcase oil sump.

* * * * *